US008322158B2

(12) United States Patent
Lee et al.

(10) Patent No.: US 8,322,158 B2
(45) Date of Patent: Dec. 4, 2012

(54) REFRIGERATOR

(75) Inventors: Dong Hoon Lee, Seoul (KR); Kyung Han Jeong, Seoul (KR); Wook Yong Lee, Seoul (KR); Joon Hwan Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 503 days.

(21) Appl. No.: 12/585,795

(22) Filed: Sep. 24, 2009

(65) Prior Publication Data

US 2011/0048052 A1 Mar. 3, 2011

(30) Foreign Application Priority Data

Sep. 3, 2009 (KR) ..... 10-2009-0083006

(51) Int. Cl.
*F25C 5/02* (2006.01)

(52) U.S. Cl. ..... 62/320; 62/340

(58) Field of Classification Search ..... 62/320, 62/344, 340, 449, 343; 222/146.6; 220/592.02
See application file for complete search history.

(56) References Cited

U.S. PATENT DOCUMENTS

| | | | | |
|---|---|---|---|---|
| 3,926,414 | A | 12/1975 | Tanguy | |
| 4,092,834 | A | 6/1978 | Lloyd | |
| 4,176,527 | A | 12/1979 | Linstromberg et al. | |
| 4,796,441 | A | 1/1989 | Goldstein | |
| 4,972,999 | A | 11/1990 | Grace | |
| 5,056,688 | A | 10/1991 | Goetz et al. | |
| 6,030,283 | A | 2/2000 | Anderson | |
| 6,082,130 | A * | 7/2000 | Pastryk et al. | 62/344 |
| 6,425,259 | B2 * | 7/2002 | Nelson et al. | 62/344 |
| 7,631,513 | B2 | 12/2009 | Chung et al. | |
| 7,743,622 | B2 * | 6/2010 | Fischer et al. | 62/344 |
| 7,762,097 | B2 | 7/2010 | Jeong et al. | |
| 2005/0072167 | A1 | 4/2005 | Oh | |
| 2006/0117784 | A1 | 6/2006 | Yang | |
| 2006/0202071 | A1 * | 9/2006 | Jung et al. | 241/34 |
| 2006/0202072 | A1 * | 9/2006 | Lee et al. | 241/101.2 |
| 2006/0213213 | A1 * | 9/2006 | Chung et al. | 62/344 |
| 2006/0242971 | A1 | 11/2006 | Cole et al. | |
| 2007/0079626 | A1 | 4/2007 | Comerci et al. | |
| 2007/0084230 | A1 * | 4/2007 | Krause et al. | 62/344 |
| 2007/0214825 | A1 | 9/2007 | Jeong et al. | |
| 2008/0134709 | A1 * | 6/2008 | Fischer et al. | 62/344 |
| 2008/0156016 | A1 | 7/2008 | Jeong et al. | |
| 2008/0295536 | A1 * | 12/2008 | Kim et al. | 62/340 |
| 2008/0295538 | A1 * | 12/2008 | Kim et al. | 62/354 |
| 2009/0145157 | A1 | 6/2009 | Jeong et al. | |

FOREIGN PATENT DOCUMENTS

| | | |
|---|---|---|
| JP | 56-47453 | 4/1981 |
| JP | 56-47454 | 4/1981 |

* cited by examiner

*Primary Examiner* — Mohammad Ali
(74) *Attorney, Agent, or Firm* — McKenna Long & Aldridge LLP

(57) ABSTRACT

A refrigerator includes an ice storage bin, an opening provided in the ice storage bin through which ice is discharged, and a plurality of blades provided in the ice storage bin, such that the plurality of blades can rotate in a forward direction or in a reverse direction, to selectively discharge ice through the opening as whole ice or crushed ice, where gravity and the plurality of blades are the only forces exerted on the ice collected in the ice storage bin.

41 Claims, 13 Drawing Sheets

REFRIGERATOR

CROSS-REFERENCE TO RELATED APPLICATION

This application claims the benefit of Korean Patent Application No. 10-2009-0083006, filed on Sep. 3, 2009, which is hereby incorporated by reference in its entirety as if fully set forth herein.

BACKGROUND

1. Field of the Disclosure

The present disclosure relates to a refrigerator, and more particularly, to a refrigerator wherein ice stored in an ice storage bin may be discharged as whole ice or crushed ice.

2. Discussion of the Related Art

A refrigerator is a home appliance that is able store and preserve food by cooling or freezing the food using a refrigeration cycle including compression, condensation, expansion, and evaporation.

The refrigerator generally includes a refrigerator body having a storage chamber, a door mounted to the refrigerator body to open and close an opening of the refrigerator body, and an ice maker provided at the storage chamber or at the door.

At the storage chamber or the door, an ice storage bin is provided to store ice discharged from the ice maker. The ice storage bin is connected to a dispenser that dispenses ice from the refrigerator according to user selection.

SUMMARY

Conventional refrigerators have an auger that is connected to a motor. When energized, the motor causes the auger to rotate to convey ice from the ice storage bin to the dispenser. The conveyed ice is crushed by an ice crusher and dispensed. However, the auger is subject to breakage, which renders the transfer of ice to the dispenser useless. Also, the auger increases the cost of the refrigerator and complicates the manufacturing process. Further, a large motor is required to drive the auger and the ice crusher, which further increases the cost of the refrigerator.

Accordingly, a refrigerator that substantially obviates one or more problems due to limitations and disadvantages of the related art is highly desirable.

For instance, one object is to reduce the distance between the ice stored in the ice storage bin and the dispenser, and if possible, reduce a width of the ice storage bin, thereby providing a slim refrigerator.

Another object is to provide a refrigerator that allows ice, either crushed or whole, to be dispensed without an auger, thereby simplifying the ice storage bin of the refrigerator.

Additional advantages, objects, and features will be set forth in part in the description which follows and in part will become apparent to those having ordinary skill in the art upon examination of the following or may be learned from practice of the disclosure. Many objectives and advantages may be realized and attained by structures particularly pointed out in the written description and claims hereof as well as the appended drawings.

To achieve these objects and other advantages, as embodied and broadly described herein, a refrigerator includes an ice storage bin, an opening provided in the ice storage bin through which ice is discharged, and a plurality of blades provided in the ice storage bin, such that the plurality of blades can rotate in a forward direction or in a reverse direction, to selectively discharge ice through the opening as whole ice or crushed ice, where gravity and the plurality of blades are the only forces exerted on the ice collected in the ice storage bin.

In another aspect, a refrigerator includes a refrigerator body having a storage chamber, a door hingedly provided at the refrigerator body to open and close the storage chamber, an ice storage bin detachably provided in the door, and an opening provided in the ice storage bin through which ice is discharged. A guide slope is provided in the ice storage bin to guide ice stored in the ice storage bin such that the ice moves toward a plurality of rotary blades by gravity, where the plurality of rotary blades is capable of rotating in a forward direction or in a reverse direction, and the plurality of rotary blades are disposed over the discharge port and a ice storage space to selectively discharge ice stored in the ice storage space as whole ice or crushed ice. The ice storage space is defined by the guide slope and a wall of the ice storage bin.

In yet another aspect, a refrigerator includes a refrigerator body having a storage chamber, a door hingedly provided at the refrigerator body to open and close the storage chamber, an ice storage bin detachably provided in the door or in the refrigerator body, and a discharge unit provided in the ice storage bin, the discharge unit having a discharge port through which ice is discharged. A guide slope is provided in the ice storage bin to guide ice stored in the ice storage bin such that the ice moves toward the discharge unit. An ice discharge member is provided in the ice storage bin, such that the ice discharge member is rotated in a forward direction or in a reverse direction, the ice discharge member being disposed between the discharge unit and the ice storage space, such that ice stored in the ice storage space does not escape from the ice storage space in a stopped state, and to selectively discharge the ice stored in the ice storage space in a cube ice state or in a crushed ice state. A drive motor rotates the ice discharge member, and an ice discharge member rotation shaft is mounted in the ice storage bin in a depressed manner to selectively connect the ice discharge member to the drive motor. The ice storage bin has a slope formed at a region where the ice discharge member rotation shaft is surrounded.

It is to be understood that both the foregoing general description and the following detailed description are exemplary and explanatory and are not intended to limit the scope of the claims.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention. In the drawings.

DETAILED DESCRIPTION OF THE EXEMPLARY EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Figure 1:
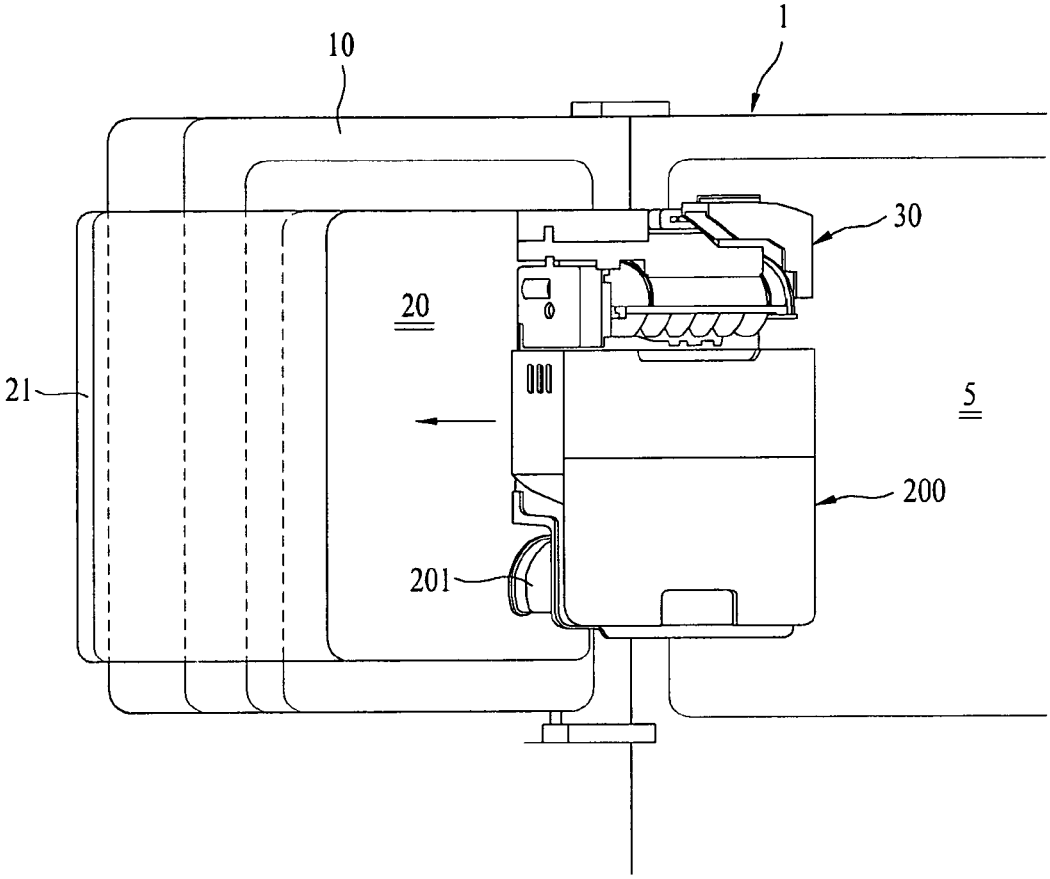
FIG. 1 is a view showing a refrigerator according to an embodiment of the present invention having an ice storage bin and an ice maker mounted therein.

As shown in FIG. 1, a refrigerator according to an embodiment of the present invention includes a refrigerator body 1 having a storage chamber 5 defined therein and a door 10 hingedly mounted to the refrigerator body 1 to open and close the storage chamber 5.

An ice making chamber 20 is formed at an inner surface of the door 10. At the ice making chamber 20, an ice maker 30 is provided to make ice and an ice storage bin 200 is provided to store ice discharged from the ice maker 30.

At the rear of the ice storage bin 200, a drive motor 201 is provided to drive an ice discharge member 300 (See FIG. 2) provided in the ice storage bin 200.

An ice making chamber door 21 is provided at one side of the ice making chamber 20 to selectively open and close the ice making chamber 20.

Figure 2:
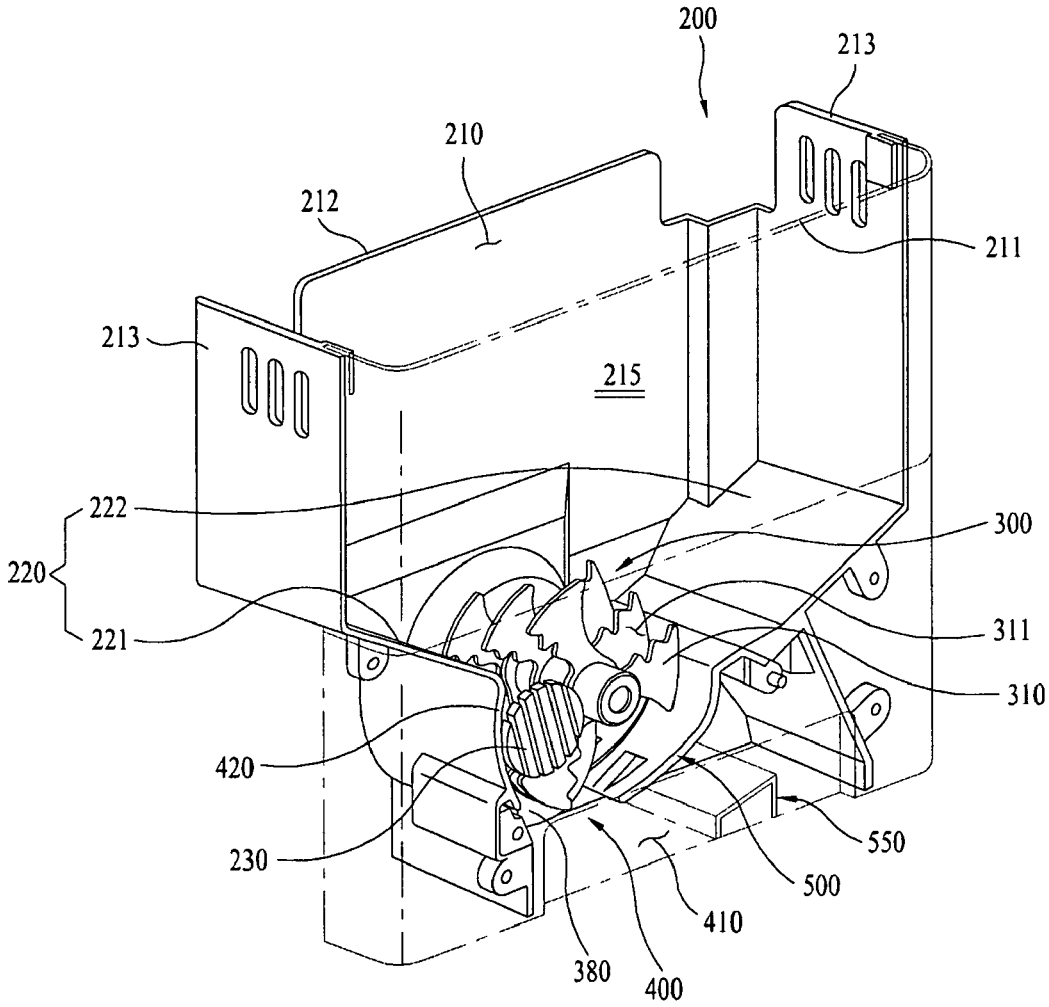
FIG. 2 is a perspective view of the ice storage bin of the refrigerator according to the embodiment of the present invention.

As shown in FIG. 2, the ice storage bin 200 includes a top opening 210, a front wall 211, a rear wall 212, and side walls 213.

The ice storage bin 200 further includes guide slopes 220 which could support ice stored in the ice storage bin 200 and, in addition, provides a path for the stored ice such that the stored ice slides downward by gravity.

The front wall 211, the rear wall 212, and the side walls 213, together with the guide slopes 220 define an ice storage space 215 to store ice.

The guide slopes 220, which numbers two in this embodiment, are spaced apart from each other. In other embodiments, one guide slope may be provided or more than two guide slopes may be provided. The respective guide slopes 220 are inclined downward toward the center of the ice storage bin 200. However, the guide slopes could be designed to provide a path anywhere towards any part of the bottom of the ice storage bin 200 in order to achieve a desired result.

The guide slopes 220 include a first guide slope 221 and a second guide slope 222. The slope angles of the first guide slope 221 and the second guide slope 222 may be similar or they may be different. For example, the first slope 221 may have a steeper angle than the second slope, or the second slope may have a steeper angle than the first slope.

An ice discharge member 300 is provided between the first guide slope 221 and the second guide slope 222 to discharge ice stored in the ice storage bin 200 out of the ice storage bin 200.

That is, the first guide slope 221 and the second guide slope 222 are located at opposite sides of the ice discharge member 300.

Preferably, the ice discharge member 300 may include at least two rotary blades 310 each having ice receiving parts 311 to receive ice. However, it is conceivable that one blade may be used in the discharge member 300.

The ice in the ice storage bin 200 that makes contact with either the first guide slope 221 or the second guide slope 222 is urged towards the ice discharge member 300 by gravity. When the ice discharge member 300 is operational, the ice is dispensed out of the refrigerator by the operation of the ice discharge member 300.

Between the first guide slope 221 and the second guide slope 222, a discharge unit 400 is provided to which the ice discharge member 300 is rotatably mounted and, in addition, the discharge unit 400 has a discharge port 410 through which ice is finally discharged outside.

The ice discharge member 300 is mounted to the discharge unit 400 such that the ice discharge member 300 can rotate in a forward direction or in a reverse direction (or in alternating directions).

At one side of the lower part of the ice discharge member 300, i.e., at one side of the discharge unit 400, are stationary blades 380 that, in cooperation with the rotary blades 310, crush ice into crushed ice when the ice discharge member 300 is rotated in a first rotational direction.

In this embodiment, the number of the stationary blades 380 is at least two. As the rotary blades 310 pass through spaces defined between the stationary blades 380, any ice that is caught between the stationary blades 380 and the rotary blades 310 is crushed into crushed ice.

On the other hand, an opening and closing member 500 selectively connects the discharge port 410 with the storage space 215 in such a manner that the storage space 215 can communicate with the discharge port 410 when the blades of the ice discharge member 300 rotate in a second rotational direction which is opposite to the first rotational direction, to dispense whole ice.

When the rotary blades 310 of the ice discharge member 300 rotate in a second direction, ice captured by ice receiving parts provided at the rotary blades 310 pushes against the opening and closing member 500 when the ice makes contact with the opening and closing member 500.

One end of the pushed opening and closing member 500 is hingedly connected to an end of the second guide slope 222. Ice making contact with the opening and closing member 500 causes a space between the opening and closing member 500 and the rotary blades 310 to widen, resulting in the ice being discharged to the discharge port 410 through the widened space. The ice is discharged as whole ice and reaches a dispenser (not shown).

Below the opening and closing member 500, an operation restriction unit 550 is provided to restrict an operation range of the opening and closing member 500 in order to prevent ice from being excessively discharged to the discharge port 410.

To summarize above, when the ice discharge member 300 is rotated in the first rotational direction, ice caught between the rotary blades 310 and the stationary blades 380 is crushed into crushed ice. As a result, the ice is discharged to the discharge port 410 as crushed ice.

On the other hand, when the ice discharge member 300 is rotated in the second rotational direction, ice caught by the rotary blades 310 pushes the opening and closing member 500 to open between the rotary blades 310 and the opening and closing member 500. As a result, the ice is discharged to the discharge port as whole ice.

At a region where the stationary blades 380 are mounted, the discharge unit 400 has a wall formed in a shape that contours a rotation track of the rotary blades 310.

Such a wall of the discharge unit 400 is shown a discharge guide wall 420. The discharge guide wall 420 may be rounded to have a curvature contouring the rotation track of the rotary blades 310.

Due to the rounded nature of the discharge guide wall 420, crushed ice is prevented from remaining in the discharge unit 400 and slips from the discharged guide wall 420 to be entirely discharged outside.

At the rear of the front wall 211 of the ice storage bin 200, an ice catching prevention part 230 protrudes toward the rotary blades 310 to prevent ice from being caught between the rotary blades 310 and the front wall 211 of the ice storage bin 200.

Figure 3:
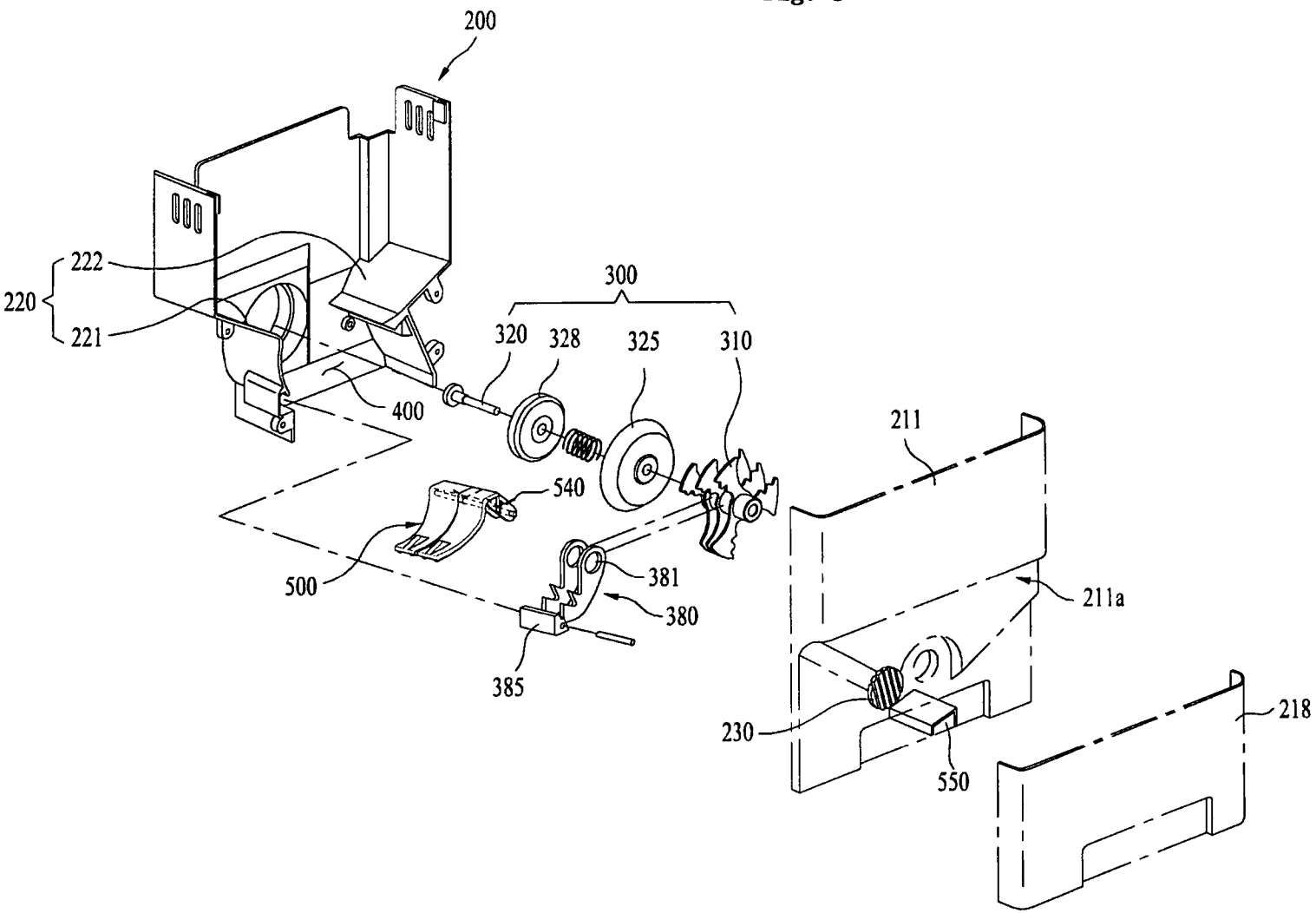
FIG. 3 is an exploded perspective view of the ice storage bin of the refrigerator according to the embodiment of the present invention.

As shown in FIG. 3, the ice discharge member 300 includes a rotary shaft 320 to which the plurality of rotary blades 310 are fixedly mounted. In this embodiment, the rotary shaft 320 extends through a space plate 325 provided behind the rotary blades 310 and a connection plate 328 connected to the drive motor 201 (See FIG. 1). The space plate 325 aids in the spacing of the rotary blades 310 and/or prevents ice from slipping through a space formed between the rotary blades 310 and the rear wall 212, for example. The space plate 325, however, may be eliminated if proper spacing between the rotary blades 310 can be maintained in order to crush ice and/or the space formed between the rotary blades 325 and the rear wall 212 can be maintained such that ice will not slip through that space. The space plate 325 may be in co-rotation with the rotary shaft 320 or be fixed in place.

The rotary blades 310 are spaced apart from each other. The rotary blades 310 are fixedly mounted to the rotary shaft 320 such that the rotary blades 310 rotates with the rotary shaft 320.

As previously described, there are a plurality of stationary blades 380. One end of each of the stationary blades 380 is mounted to the rotary shaft 320.

A through-hole 381 is formed at one end of each of the stationary blades 380 through which the rotary shaft 320 is inserted. However, the through-hole 381 may have a greater diameter than the rotary shaft 320 such that the stationary blades 380 are not moved even though the rotary shaft 320 is rotating.

Also, one end of each of the stationary blades 380 may be disposed between two adjacent rotary blades 310.

The other end of each of the stationary blades 380 may be fixed to one side wall of the discharge unit 400.

To this end, the other end of each of the stationary blades 380 is connected to a fixing member 385, and the fixing member 385 is inserted into one side wall of the discharge unit 400, to fix the stationary blades 380 to the one side wall in a manner such that the stationary blades 380 do not move.

Meanwhile, a single opening and closing member 500 is provided. However, two or more opening and closing members 500 may be provided to achieve a desired result. The opening and closing member 500 is disposed beside the stationary blades 380.

The opening and closing member 500 is attached to the discharge unit 400 by a hinge such that the opening and closing member 500 moves about the hinge from the discharge unit 400. The opening and closing member 500 may be supported by an elastic member 540 such as a spring. Alternatively, the opening and closing member 500 may be formed of an elastic material, and thereby the hinge may not be required.

As a result, the opening and closing member 500 returns to its original position when the pressure asserted by the ice on the opening and closing member 500 is released after the ice has traveled to the end of the opening and closing member 500 and slipped out of the end of the opening and closing member 500.

After the ice discharge member 300, the stationary blades 380, and the opening and closing member 500 are mounted to the ice storage bin 200, a front plate 211*a* forming the front wall 211 of the ice storage bin 200 is mounted to the ice storage bin 200.

To the lower part of the front of the front plate 211*a*, a cover member 218 may be mounted to cover the opening and closing member 500 or the stationary blades 380 such that the opening and closing member 500 or the stationary blades 380 are not exposed to the outside environment.

Figure 4:
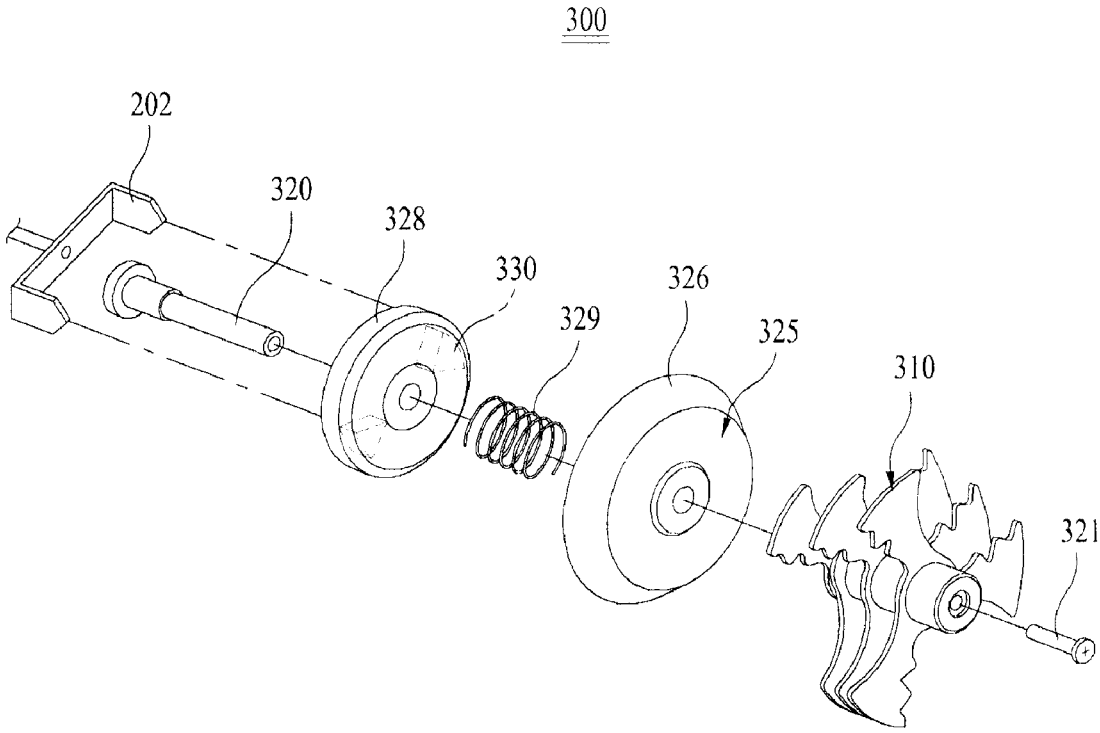
FIG. 4 is an exploded perspective view showing an ice discharge member of the refrigerator according to the embodiment of the present invention.

As shown in FIG. 4, the ice discharge member 300 according to this embodiment includes the plurality of rotary blades 310 fixedly mounted to the rotary shaft 320, the space plate 325, and the connection plate 328.

Between the space plate 325 and the connection plate 328, an elastic member 329, in a form of a coil spring, may be mounted to elastically support the connection plate 328.

The rotary blades 310, the space plate 325, the connection plate 328, and the elastic member 329 are prevented from being separated from the rotary shaft 320 by an insertion member 321 that is inserted into the front end of the rotary shaft 320 such that the rotary blades 310, the space plate 325, the connection plate 328, and the elastic member 329 are coupled to the rotary shaft 320.

At a drive shaft of the drive motor 201 (See FIG. 1), a hook member 202 is provided to which the connection member 328 is detachably connected. The connection plate 328 has a catching protrusion 330 by which the hook member 202 catches to the connection plate 328.

When a user mounts the ice storage bin 200 to the door 10 (See FIG. 1), the catching protrusion 330 may overlap with the hook member 202, such that the hook member 202 may not catch the catching protrusion 330. In this case, a driving force of the drive motor 201 (See FIG. 1) may not be transmitted to the ice discharge member 300 even though the drive motor 201 is operational.

To ensure that the driving force of the drive motor 201 gets transmitted to the ice discharge member 300, the connection plate 328 first moves toward the space plate 325 when the catching protrusion 330 overlaps with the hook member 202 such that the hook member 202 catches the catching protrusion 330.

Subsequently, when the catching protrusion 330 is released from the hook member 202 due to a release from the drive motor 201, the connection plate 328 moves backward by the elastic force of the elastic member 329.

In an alternative embodiment, the space plate 325 may be part of and fixed the rear wall 212, or the space plate 325 may be screwed to the rear wall 212. In this embodiment, the hook member 202, the connection plate 328, and the elastic member 329 may not be required. The motor 201 directly connects to the rotary shaft 320 to drive the rotary blades 310.

According to one embodiment, a slope is formed at a rim of the space plate 325 such that ice may slide from the rim of the space plate 325 to the rotary blades 310.

The plurality of rotary blades 310 are spaced apart from each other. The spaced distance between the neighboring rotary blades 310 is usually less than the size of the ice.

Figure 5:
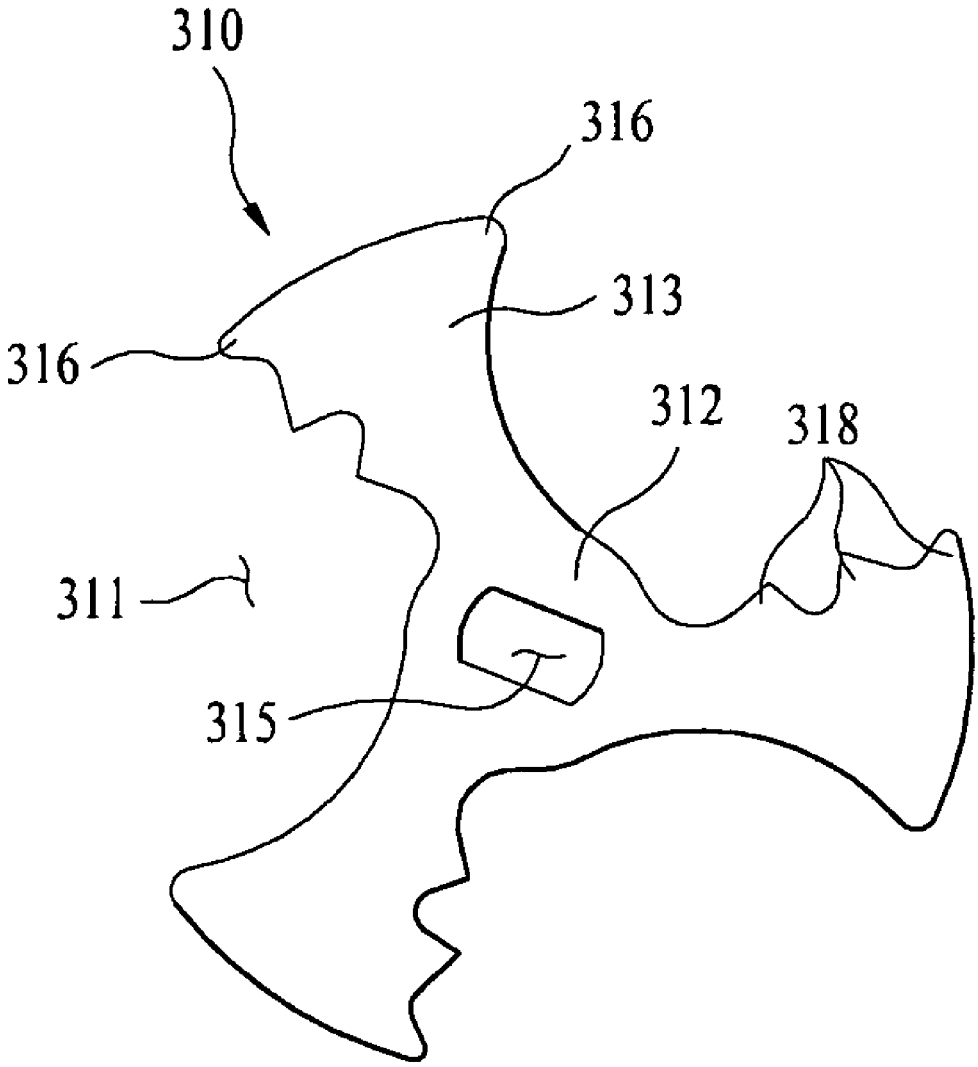
FIG. 5 is a front view showing a rotary blade of the refrigerator according to the embodiment of the present invention.

As shown in FIG. 5, each of the rotary blades 310 includes a central part 312 through which the rotary shaft extends and extensions 313 radially extend from the central part 312.

The central part 312 is provided with a slot hole type through-hole 315 through which the rotary shaft 320 extends such that the rotational motion of the rotary shaft 320 is transmitted to the central part 312.

The plurality of extensions 313 are spaced apart from each other, and ice receiving parts 311 to receive ice are provided between the neighboring extensions 313.

Each of the extensions 313 generally has a width that increases when traveling from the inside end thereof to the outside end thereof. Also, catching protrusions 316 to prevent ice received in the corresponding ice receiving part 311 from being separated from the corresponding ice receiving part 311 or rolling over the corresponding ice receiving part 311 are formed at opposite sides of the outside end of each of the extensions 313.

When the rotary blades 310 rotate with ice received in the ice receiving part 311, ice located at the outside ends of the extensions 313 is caught by the catching protrusions 316, such that the ice moves in the rotational direction of the rotary blades 310.

At one side of each of the extensions 313, a saw-toothed crushing part 318 is provided to crush ice in cooperation with the stationary blades 380.

The other side of each of the extensions 313, i.e., the side of each of the extensions 313 opposite to the crushing part 318, is smooth such that ice can move with the rotary blades 310 without being crushed.

Therefore, the crushing part 318 is located opposite to the smooth side in each of the ice receiving part 311.

Figure 6:
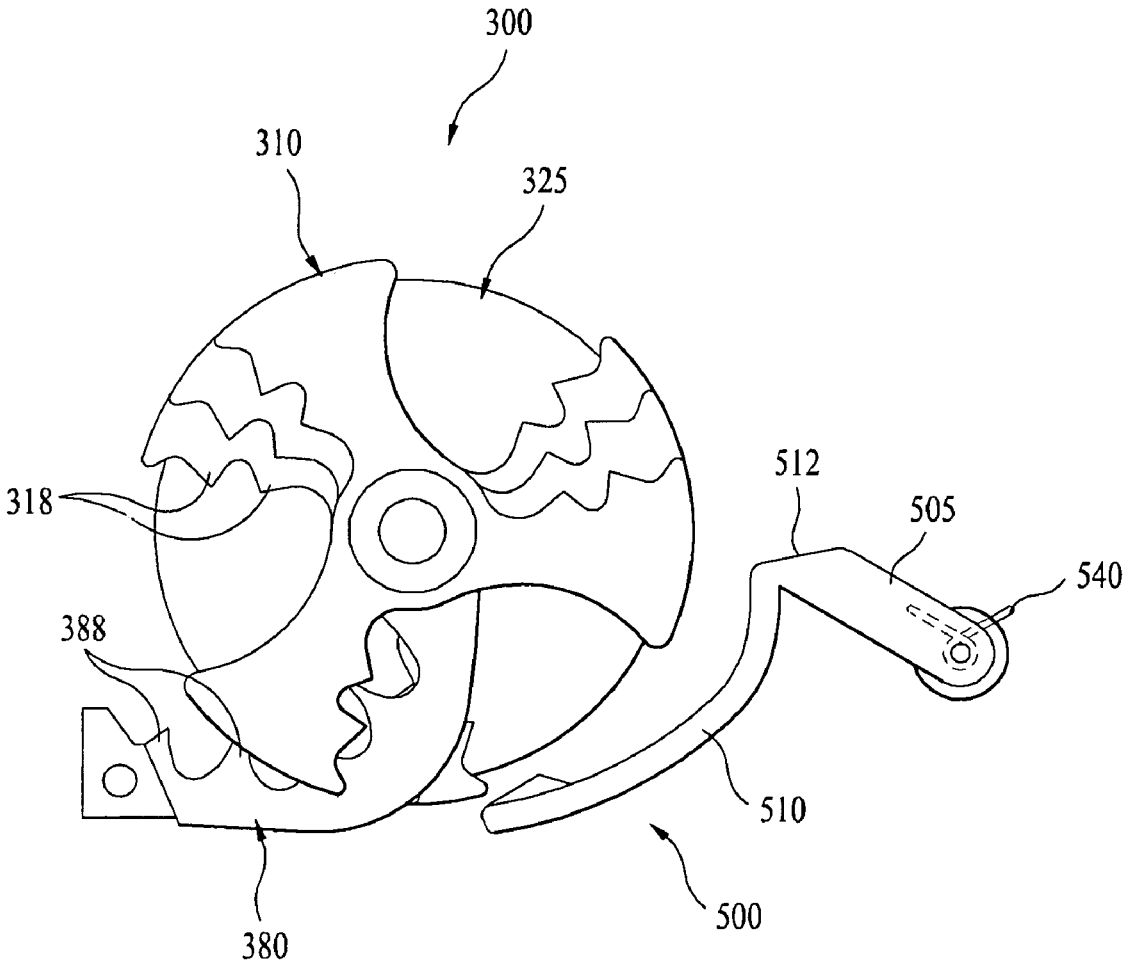
FIG. 6 is a front view showing the ice discharge member, a fixing blade, and an opening and closing member of the refrigerator according to the embodiment of the present invention.

When the rotary blades 310 are fixedly mounted to the rotary shaft 320, as shown in FIG. 6, the rotary blades 310 may not aligned with each other but may be offset to some extent from each other.

That is, when viewed from in front, the rotary blades 310 may not fully overlap but may be offset by a predetermined angle.

This may enhance the crushing of ice because when the rotary blades 310 rotate toward the stationary blades 380 to crush ice, pressure applied to the ice may diffuse and weaken over the plural rotary blades 310 in a structure in which the rotary blades 310 fully overlap with each other, with the result that crushing the ice may be difficult.

On the other hand, when the rotary blades 310 are offset to some extent as described above, ice is crushed by contact between the ice and the crushing part 318 of the first rotary blade 310. After that, the ice comes into contact with the crushing part 318 of the second rotary blade 310 and then the crushing part 318 of the third rotary blade 310 at regular intervals.

Consequently, rotational force from the ice discharge member 300 is concentrated on the respective crushing parts 318, with the result that ice crushing efficiency is considerably improved.

A saw-toothed crushing part 388 to crush ice may be provided at each of the stationary blades 380. Each of the stationary blades 380 may be formed in an "L" shape. However, the shape of each of the stationary blades 380 is not particularly restricted.

The opening and closing member 500 is provided beside the stationary blades 380. The opening and closing member 500 includes a hinge type rotation part 505 hingedly mounted to the ice storage bin 200. The hinge type rotation part 505 is provided with an elastic member 540 formed in the shape of a torsion spring to elastically support the opening and closing member 500.

One end of the elastic member 540 is fixed to the ice storage bin 200, and the other end of the elastic member 540 is mounted to one side of the opening and closing member 500 to elastically support the opening and closing member 500.

When the pressure applied to the opening and closing member 500 from the ice is released after the ice has slipped away from the opening and closing member 500, the tensed elastic member 540 returns to its original position thereby closing the opening and closing member 500.

The opening and closing member 500 includes a first guide way 510 provided in the vicinity of the rotation track of each of the rotary blades 310 and a second guide way 512 connected to the first guide way 510 and the hinge type rotation part 505.

The first guide way 510 and the second guide way 512 are disposed in an inclined manner. The second guide way 512 may be continuous with the second guide slope 222 (See FIG. 2).

The first guide way 510 may be circular in shape that contours the rotation track of each of the rotary blades 310 to guide the discharge of ice.

Figure 7:
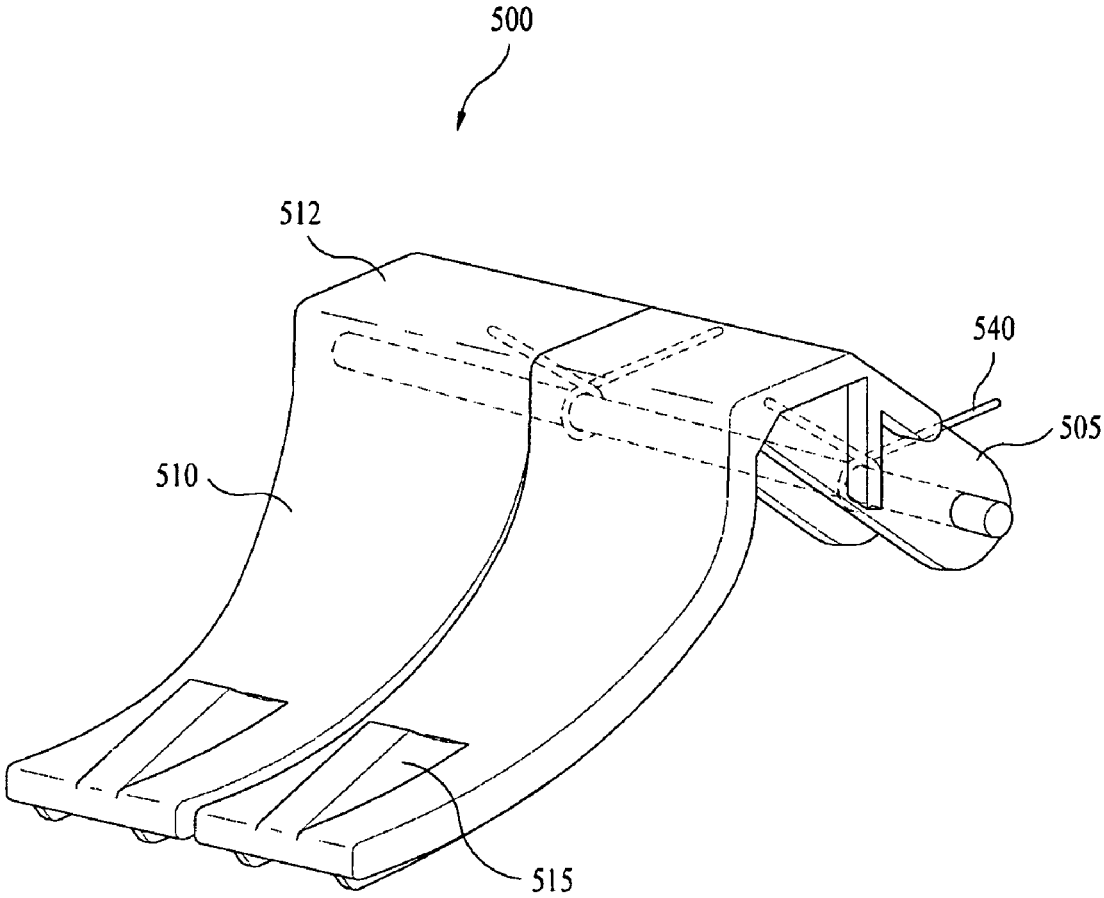
FIG. 7 is a perspective view of the opening and closing member of the refrigerator according to the embodiment of the present invention.

As shown in FIG. 7, a plurality of opening and closing members 500 may be provided. The respective opening and closing members 500 are independently operated. Therefore, the operation of one of the opening and closing members 500 does not affect the operation of the other opening and closing members 500.

The reason that the plurality of opening and closing members 500 are provided, and the respective opening and closing members 500 are independently operated is as follows.

If only one opening and closing member 500 is provided, for example, some ice cubes coming through the guide way of the opening and closing member 500 may be remain on a portion of the guide way without being discharged, such that the other ice cubes may pass downward through a gap formed at the other portion in which no ice cubes are present resulting in an unintended discharge of ice cubes.

In the structure in which the plurality of opening and closing members 500 are provided, even though some ice cubes are caught by one of the opening and closing members 500, with the result that the one of the opening and closing members 500 remain open, the other opening and closing members 500 by which no ice cubes are caught remain closed, thereby preventing the other ice cubes from being unintentionally discharged.

To this end, the elastic member 540 may be provided for each of the opening and closing members 500.

Each of the opening and closing members 500 is provided with a catching protrusion 515 to prevent ice caught between each of the opening and closing members 500 and the rotary blades 310 from being discharged outside when each of the opening and closing members 500 is closed.

The catching protrusion 515 may be provided on a top surface of the first guide way 510.

Figure 8:
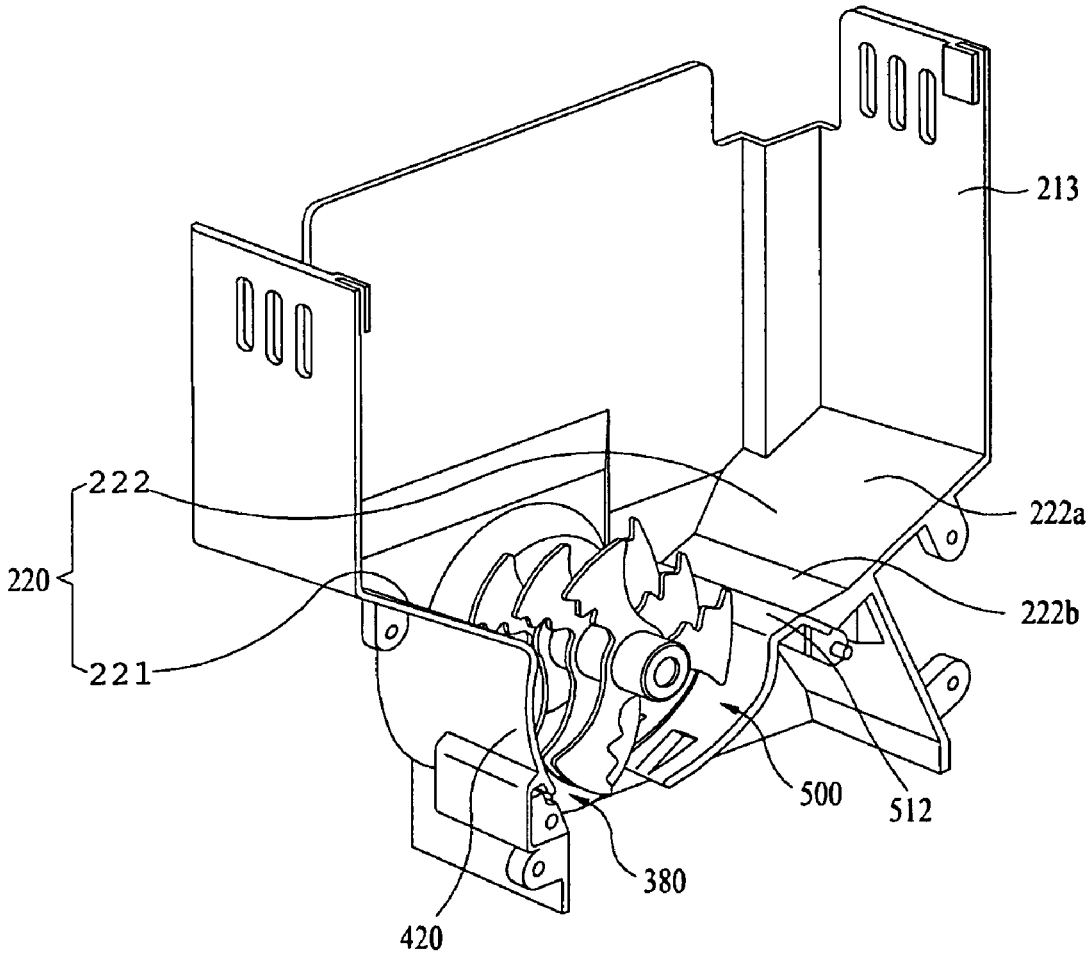
FIG. 8 is an interior perspective view of the ice storage bin of the refrigerator according to the embodiment of the present invention.

As shown in FIG. 8, the first guide slope 221 is provided in the vicinity of the stationary blades 380, and the second guide slope 222 is provided in the vicinity of the opening and closing members 500.

At one side of the discharge unit 400, a discharge guide wall 420 is provided that extends downward towards the discharge port 410.

The discharge guide wall 420 may be provided above a region where one end of each of the stationary blades 380 is fixed. The discharge guide wall 420 guides the discharge of crushed ice in order to prevent the crushed ice from remaining in the ice storage bin 200.

The discharge guide wall 420 may be formed in the shape of a round wall depressed outward such that the discharge guide wall 420 has a predetermined curvature.

The second guide slope 222 may be divided into two sloped parts such that the speed of ice moving to the ice discharge member 300 along the second guide slope 222 may be adjusted in order to prevent the ice from breaking apart.

To this end, the second guide slope 222 includes an outside guide slope 222*a* connected to a corresponding one of the side walls 213 of the ice storage bin 200 and an inside guide slope 222*b* connected to the outside guide slope 222*a*, and the inside guide slope 222*b* is disposed in the vicinity of the ice discharge member 300.

The inside guide slope 222*b* has a lower gradient than the outside guide slope 222*a* (see FIG. 9) such that the speed of ice sliding downward along the guide slope 222*a* is reduced when the ice encounters the guide slope 222*b*.

The second guide way 512 of each of the opening and closing members 500 is disposed at one end of the inside guide slope 222*b* such that the second guide way 512 is continuous with the inside guide slope 222*b*.

When the discharge port 410 is closed by the opening and closing members 500, the speed of ice is reduced since the slope of the second guide way 512 is similar to the slope of the guide slope 222*b*.

When the discharge port 410 is opened by the opening and closing members 500, the second guide way 512 is moved downward forming a steeper slope that guides ice toward the discharge port 410 faster.

Figure 9:
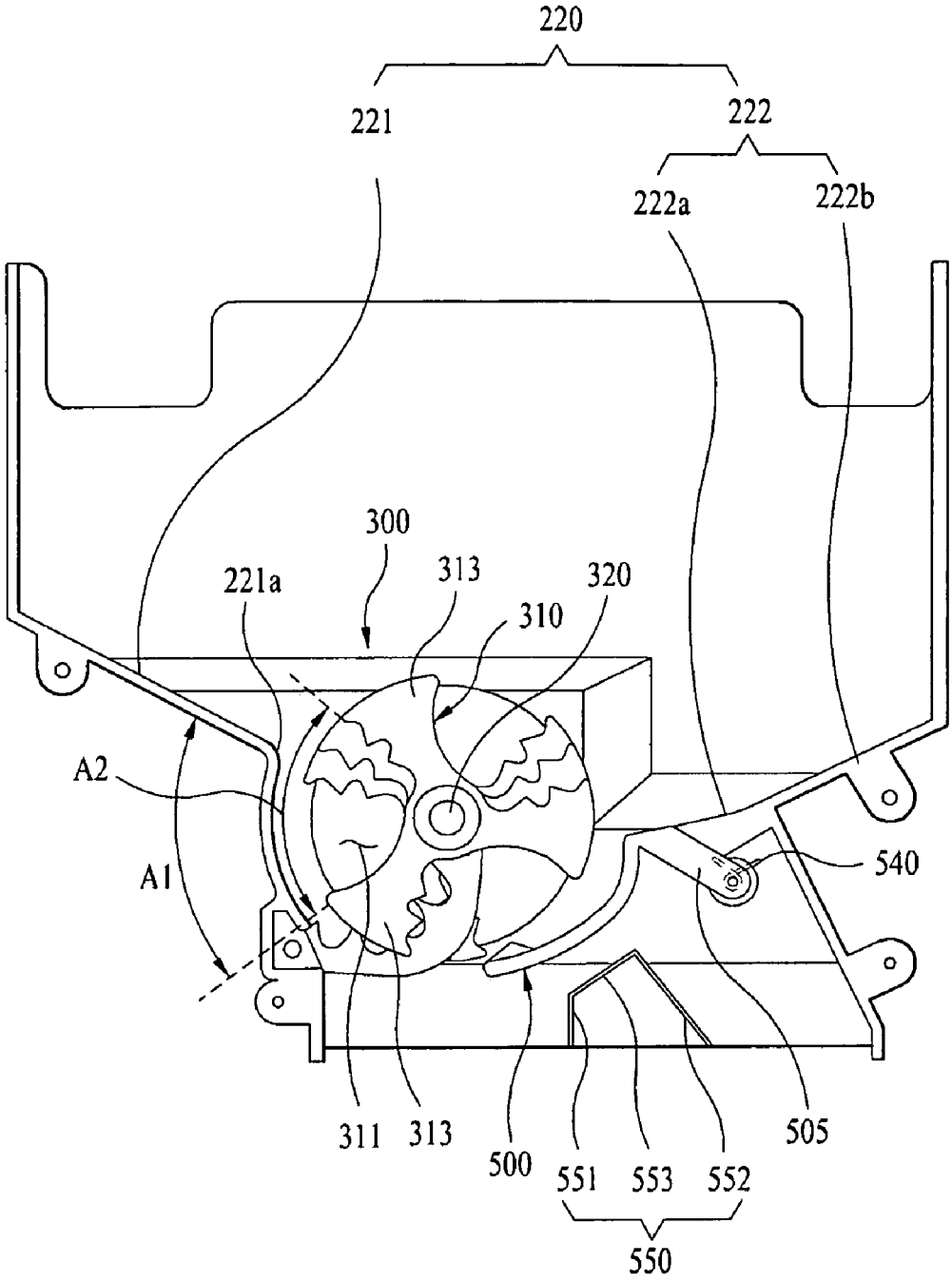
FIG. 9 is an interior front view of the ice storage bin of the refrigerator according to the embodiment of the present invention.

As shown in FIG. 9, the first guide slope 221 may have a higher slope end point 221*a* than the rotary shaft 320 of the ice discharge member 300. However, some embodiment may have the rotary shaft 320 be level with the end point of the first guide slope. It may be desirable that the rotary shaft 320 may be level with an end point of the second guide slope 222 or higher than the end point of the second guide slope 222. One aspect of the position of the rotary shaft with respect to the guide slopes may be the ease that the rotary blades can move the ice on the guide slopes.

In this structure, some ice crushed at a region where the stationary blades 380 are disposed is prevented from moving upward along the first guide slope 221.

The curvature of the discharge guide wall 420 to prevent some crushed ice from remaining in the ice storage bin 200 may be equivalent to the curvature corresponding to the rotation track of each of the rotary blades 310. An arc A1 forming the discharge guide wall 420 may have a length corresponding to the distance between the neighboring extensions 313 of each of the rotary blades 310, i.e., the maximum width A2 of each of the ice receiving parts 311.

Ice is crushed in each of the ice receiving parts 311. In the above structure, therefore, ice crushed in each of the ice receiving parts 311 collides with the discharge guide wall 420, with the result that the crushed ice drops downward.

On the other hand, the second guide slope 222 may have a lower gradient than the first guide slope 221 such that ice remains as whole ice.

The gradient of the inside guide slope 222*b* of the second guide slope 222 may be substantially equal to that of the second guide way 512 of each of the opening and closing members 500 such that the inside guide slope 222*b* of the second guide slope 222 is continuous with the second guide way 512 of each of the opening and closing members 500. Also, the hinge type rotation part 505 of each of the opening and closing members 500 may be located lower than the rotary shaft 320 of the ice discharge member 300 such that the gradient of the second guide slope 222 is lower than that of the first guide slope 221.

That is, if the hinge type rotation part 505 of each of the opening and closing members 500 is located higher than the rotary shaft 320 of the ice discharge member 300, the second guide slope 222 is much steeper, which is contrary to reducing the speed of ice.

In consideration of a structural property in which the hinge type rotation part 505 of each of the opening and closing members 500 is located below the second guide slope 222, therefore, the hinge type rotation part 505 of each of the opening and closing members 500 may be located lower than the rotary shaft 320 of the ice discharge member 300.

If the opening angle of the each of the opening and closing members 500 is too large, an excessive amount of ice may be discharged. For this reason, it is desirable to restrict the opening angle of the each of the opening and closing members 500.

Therefore, the operation restriction unit 550 is provided below the opening and closing members 500 to restrict the opening angle of each of the opening and closing members 500.

The operation restriction unit 550 includes a first vertical rib 551, a second rib 552 spaced apart from the first rib 551, the second rib 552 being higher than the first rib 551, and an inclined contact part 553 to interconnect the upper end of the first rib 551 and the upper end of the second rib 552. The contact part 553 is configured to contact each of the opening and closing members 500.

That is, each of the opening and closing members 500 comes into contact with the contact part 553, with the result that the opening degree of the each of the opening and closing members 500 is restricted.

As previously described in detail, the plurality of opening and closing members 500 may be provided, and therefore, depending on the shape of the operation restriction unit 550, the respective opening and closing members 500 may have different maximum opening degrees.

This reflects that the rotary blades 310 are mutually offsetted to some extent, and therefore, the ice receiving parts 311 of one of the rotary blades 310 are offset with respect to the ice receiving parts 311 of the other the rotary blades 310.

Figure 10:
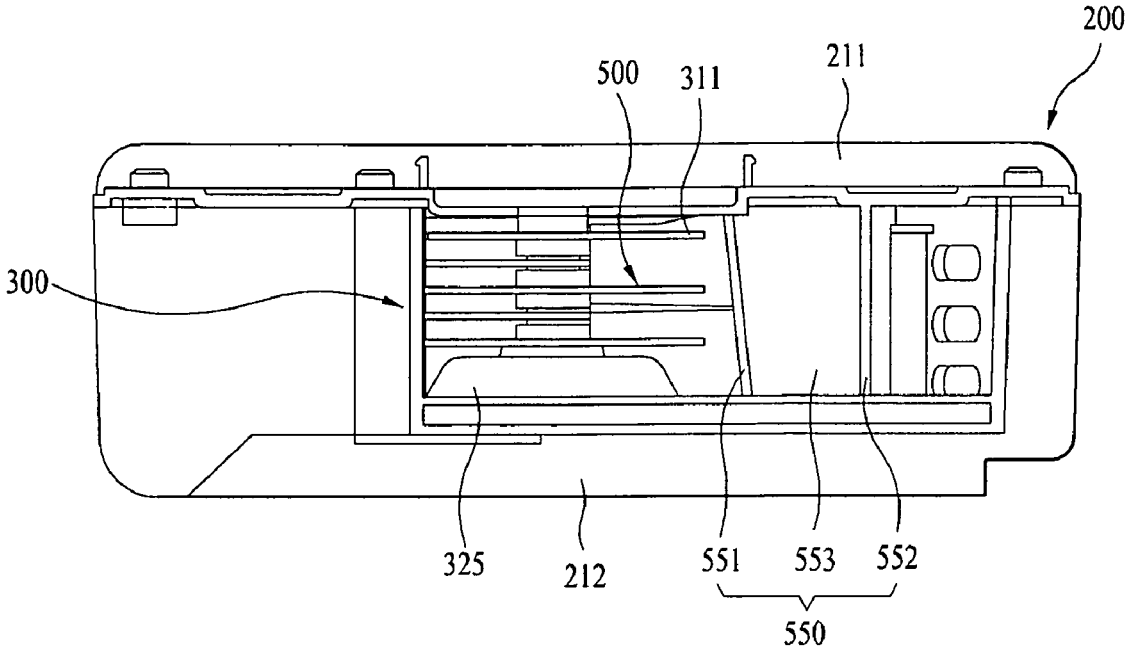
FIG. 10 is a bottom plan view of the ice storage bin of the refrigerator according to the embodiment of the present invention.

The lower part of the operation restriction unit 550 is shown in FIG. 10.

In this drawing, the lower side of the ice storage bin 200 is the rear of the ice storage bin 200, and the upper side of the ice storage bin 200 is the front of the ice storage bin 200.

As shown in FIG. 10, two opening and closing members 500 are provided such that the opening and closing members 500 are independently operated.

The first rib 551 is disposed at an angle from the rear to the front of the ice storage bin 200 such that the first rib 551 is directed inward towards the center of the ice storage bin 200.

Consequently, the ice discharge area is gradually increased from the front to the rear of the ice storage bin 200.

According to one embodiment, the opening and closing member 500 disposed at the front of the ice storage bin 200 has a lower rotational angle than the other opening and closing member 500 disposed at the rear of the ice storage bin 200.

Such construction of the first rib 551 reflects that, as previously described in detail, the plurality of rotary blades 310 do not fully overlap but are mutually offsetted to some extent.

Figure 11:
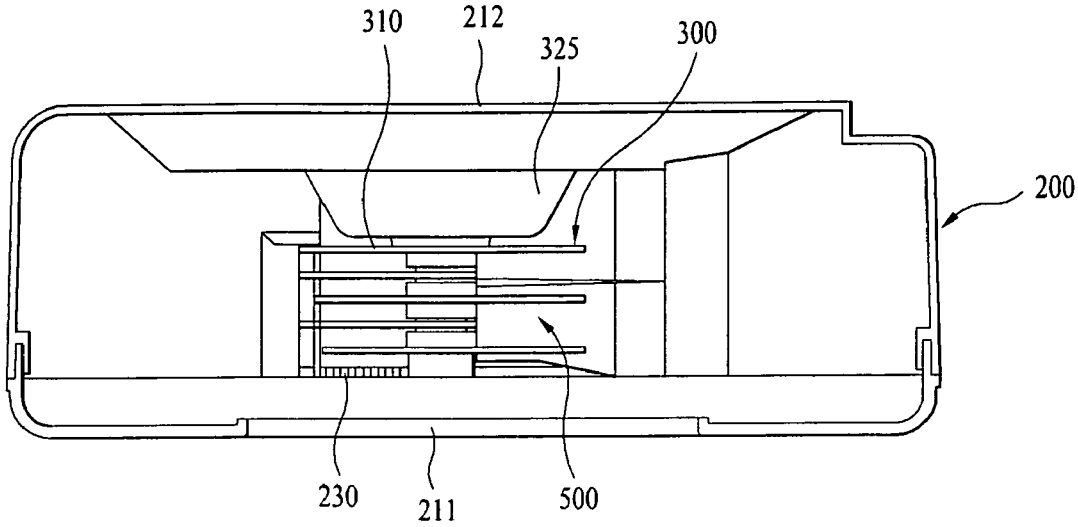
FIG. 11 is a top plan view of the ice storage bin of the refrigerator according to the embodiment of the present invention.

FIG. 11 is a top plan view of the ice storage bin 200.

The ice catching prevention part 230 is provided inside the front wall 211 of the ice storage bin 200.

The ice catching prevention part 230 protrudes or extends inward from inside the front wall 211 of the ice storage bin 200. As a result, the ice catching prevention part 230 occupies a space between the frontmost one of the rotary blades 310 and the front wall 211 of the ice storage bin 200.

The ice catching prevention part 230 may be provided above a region where crushed ice is discharged.

At a region where cube ice is discharged, a space between the front wall 211 of the ice storage bin 200 and a corresponding one of the rotary blades 310 is much smaller than a cube of ice, with the result that cube ice is prevented from being caught between the front wall 211 of the ice storage bin 200 and a corresponding one of the rotary blades 310.

For crushed ice, on the other hand, the size of the crushed ice may be equal to that of the space between the front wall 211 of the ice storage bin 200 and a corresponding one of the rotary blades 310, with the result that the crushed ice may be caught between the front wall 211 of the ice storage bin 200 and a corresponding one of the rotary blades 310, which may interfere with the rotational operation of the rotary blades 310.

Such interference may be prevented by the provision of the ice catching prevention part 230.

Hereinafter, the operation of the refrigerator according to an embodiment of the present invention will be described in detail with reference to the accompanying drawings.

Figure 12:
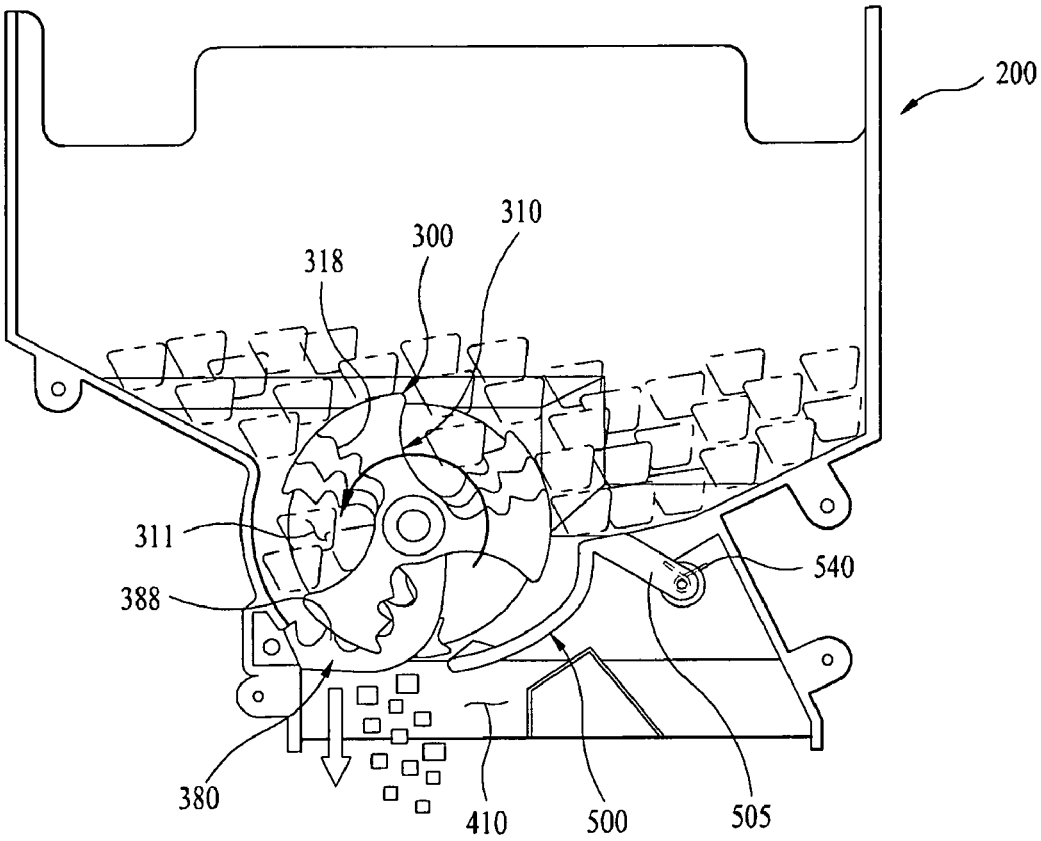
FIG. 12 is a front view showing crushed ice being discharged from the refrigerator according to the embodiment of the present invention.

When a user inputs a command to dispense crushed ice, as shown in FIG. 12, the ice discharge member 300 rotates in a first rotational direction, in this instance, counterclockwise.

As a result, the crushing parts 318 of the rotary blades 310 gradually approach the crushing parts 388 of the stationary blades 380.

Consequently, ice received in the ice receiving parts of the rotary blades 310 is placed on the stationary blades 380 by the rotation of the rotary blades 310.

When the rotary blades 310 rotate further, ice caught between the crushing parts 318 of the rotary blades 310 and the crushing parts 388 of the stationary blades 380 is crushed into crushed ice. The crushed ice then drops toward the discharge port 410 and is discharged to the outside.

During the discharge of the crushed ice, the opening and closing members 500 remain closed such that ice gathered at the opening and closing members 500 is prevented from being discharged downward.

Figure 13:
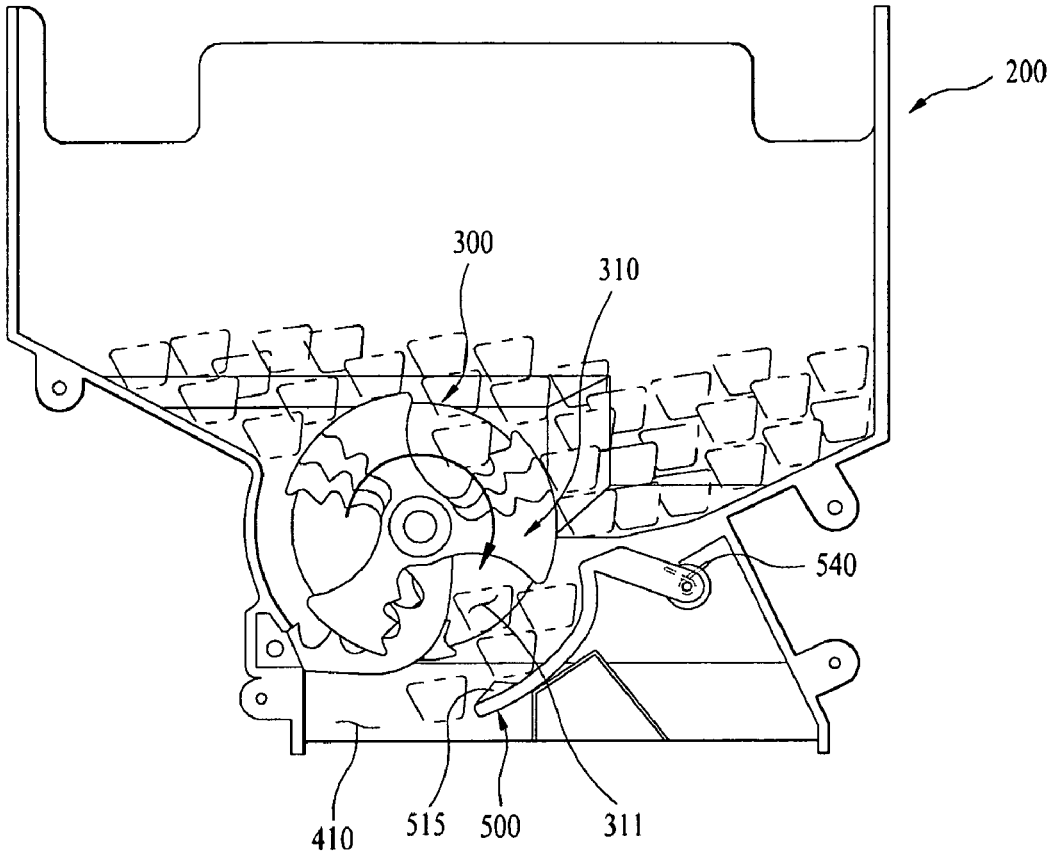
FIG. 13 is a front view showing cube ice being discharged from the refrigerator according to the embodiment of the present invention.

On the other hand, when a user inputs a command to discharge ice such that ice is discharged as whole ice, as shown in FIG. 13, the ice discharge member 300 rotates in the second rotational direction, in this instance, clockwise direction.

As a result, ice received in the ice receiving parts of the rotary blades 310 moves toward the opening and closing members 500 by the rotation of the rotary blades 310.

When the rotary blades 310 continues to rotate in this state, the extensions 311 of the rotary blades 310 push the ice placed on the opening and closing members 500.

As a result, pressure from the rotary blades 310 is applied to the opening and closing members 500 via the ice.

The opening and closing members 500 are hingedly rotated downward by the pressure from the rotary blades 310 and the ice, with the result that a space is formed between the ends of the extensions 313 of the rotary blades 310 and the corresponding ends of the opening and closing members 500, and thus the ice is discharged through the space.

The opening angle of the opening and closing members 500 is not limitless. Specifically, the bottom of each of the opening and closing members 500 comes into contact with the operation restriction unit 550 that restricts the opening angle of each of the opening and closing members 500, with the result that excessive discharge of ice is prevented.

When a predetermined amount of ice is discharged, the ice discharge member 300 stops rotating, with the result that the pressure applied to the ice from the rotary blades 310 is released.

When the pressure is released, each of the opening and closing members 500 is returned to its original position by the elastic force of the elastic member 540, with the result that each of the opening and closing members 500 is restored to its original position that is located adjacent to the end of the corresponding extension 313 of each of the rotary blades 310.

Consequently, the ice is prevented from being discharged out of the discharge port 410.

Even when the ice is placed between the rotary blades 310 and the opening and closing members 500, the ice is caught by the catching protrusions 515 of the opening and closing members 500, with the result that the ice is prevented from dropping downward toward the discharge port 410.

Ice moves toward the ice discharge member by gravity. Consequently, an additional conveyance device, such as an auger, to forcibly move ice toward the ice discharge member is not necessary, and therefore, the interior structure of the refrigerator is more simplified. The inventors who conceived the ice storage bin with the ice discharge member but no auger, have shown that better performance could be achieved without the auger, which is contrary to conventional wisdom that dictates that an auger should be used to forcibly move ice to the ice discharge member. The embodiments described above provide better performance, and yet obviates the need of an auger.

Also, most of the ice moves downward vertically. Consequently, the discharge distance of the ice is reduced, and therefore, a slim refrigerator is achieved.

It will be apparent to those skilled in the art that various modifications and variations can be made without departing from the spirit or scope of the inventions. Thus, the modifications and variations are intended to be covered by the appended claims and their equivalents.

What is claimed is:

1. A refrigerator comprising:

an ice storage bin;

an opening provided in the ice storage bin through which ice is discharged; and a plurality of blades provided in the ice storage bin, such that the plurality of blades can rotate in a forward direction or in a reverse direction, to selectively discharge ice through the opening as whole ice or crushed ice, wherein gravity and the plurality of blades are the only forces exerted on the ice collected in the ice storage bin, wherein the plurality of blades comprises at least two rotary blades, the rotary blades being spaced apart from each other, and wherein each of the rotary blades comprises:

a central part to which a rotary shaft is fixedly coupled;

at least two extensions radially extending from the central part;

catching protrusions provided at opposite ends of each of the extensions to catch ice; and a saw-toothed crushing part provided at one side of each of the extensions to contact and crush ice.

2. The refrigerator according to claim 1, further comprising:

a stationary blade provided at one side of the ice storage bin to apply pressure to ice in cooperation with the rotary blades to crush the ice when the rotary blades are rotated in a first direction; and an opening and closing member provided at another side of the ice storage bin, the opening and closing member coming into contact with the ice discharged by the rotary blades and being urged by the ice to selectively open and close the discharge port when the rotary blades are rotated in a second direction.

3. The refrigerator according to claim 1, wherein the ice storage bin is mounted at a door that opens and closes a storage chamber, and the refrigerator further comprises:

a rotary shaft that drives the rotary blades for co-rotation therewith;

a drive motor provided at the door, wherein the drive motor drives the rotary shaft in a first direction or a second direction.

4. The refrigerator according to claim 1, wherein each of the rotary blades further comprises ice receiving parts formed between the respective extensions to receive ice.

5. The refrigerator according to claim 1, wherein each of the extensions has an increasing width in the radial direction.

6. The refrigerator according to claim 2, wherein the stationary blade includes at least two stationary blades.

7. The refrigerator according to claim 6, wherein each of the stationary blades has one end mounted to a rotary shaft and the other end fixed to a side wall of the ice storage bin, and each of the stationary blades is provided at one side thereof with a saw-toothed crushing part.

8. The refrigerator according to claim 1, wherein the rotary blades are offset with respect to each other.

9. The refrigerator according to claim 2, further comprising a discharge guide wall provided at one side of the ice storage bin where the stationary blade is provided, the discharged guide wall being contoured to correspond to a rotation track of each of the rotary blades.

10. The refrigerator according to claim 2, further comprising guide slopes provided in the ice storage bin in an inclined manner and, in addition, provided at opposite sides of the rotary blades, to guide ice toward the rotary blades, wherein the guide slopes comprise a first guide slope provided at one side of the rotary blades and a second guide slope provided at the other side of the rotary blades.

11. The refrigerator according to claim 10, wherein the first guide slope is located adjacent to the stationary blade, and the second guide slope is located adjacent to the opening and closing member.

12. The refrigerator according to claim 10, wherein the first guide slope has a higher slope end point than a rotary shaft connected to the rotary blades to prevent ice crushed by the rotary blades and the stationary blade from moving along the first guide slope.

13. The refrigerator according to claim 10, wherein the second guide slope has a lower gradient than the first guide slope such that a speed of ice moving along the second guide slope is slower than a speed of ice moving along the first guide slope.

14. The refrigerator according to claim 10, wherein the opening and closing member is hingedly mounted to the ice storage bin such that the opening and closing member is continuous with the second guide slope, and the opening and closing member is returned to an original position thereof by elastic force when force urging the opening and closing member is released.

15. The refrigerator according to claim 14, wherein the opening and closing member comprises at least two opening and closing members disposed in parallel, the at least two opening and closing members being independently hingedly rotated, the at least two opening and closing members being independently returned to original positions thereof by elastic force.

16. The refrigerator according to claim 2, wherein the opening and closing member is formed of an elastic material.

17. The refrigerator according to claim 1, wherein the ice storage bin is formed of a transparent material.

18. A refrigerator comprising:

an ice storage bin;

an opening provided in the ice storage bin through which ice is discharged;

a plurality of blades provided in the ice storage bin, such that the plurality of blades can rotate in a forward direction or in a reverse direction, to selectively discharge ice through the opening as whole ice or crushed ice, wherein gravity and the plurality of blades are the only forces exerted on the ice collected in the ice storage bin; and an ice catching prevention part provided at a back side of a front wall of the ice storage bin, such that the ice catching prevention part protrudes toward the rotary blades, wherein the plurality of blades comprises at least two rotary blades, the rotary blades being spaced apart from each other.

19. A refrigerator comprising:

an ice storage bin;

an opening provided in the ice storage bin through which ice is discharged;

a plurality of blades provided in the ice storage bin, such that the plurality of blades can rotate in a forward direction or in a reverse direction, to selectively discharge ice through the opening as whole ice or crushed ice, wherein gravity and the plurality of blades are the only forces exerted on the ice collected in the ice storage bin, wherein the plurality of blades comprises at least two rotary blades, the rotary blades being spaced apart from each other; and guide slopes provided in the ice storage bin in an inclined manner and, in addition, provided at opposite sides of the rotary blades, to guide ice toward the rotary blades, wherein the guide slopes comprise a first guide slope provided at one side of the rotary blades and a second guide slope provided at the other side of the rotary blades, wherein the second guide slope comprises an outside guide slope extending from a side wall of the ice storage bin and an inside guide slope connected to the outside guide slope, the inside guide slope being provided adjacent the rotary blades, and the inside guide slope has a lower gradient than the outside guide slope to reduce a speed of ice moving to the rotary blades such that the ice is prevented from being damaged.

20. A refrigerator comprising:

an ice storage bin;

an opening provided in the ice storage bin through which ice is discharged;

a plurality of blades provided in the ice storage bin, such that the plurality of blades can rotate in a forward direction or in a reverse direction, to selectively discharge ice through the opening as whole ice or crushed ice, wherein gravity and the plurality of blades are the only forces exerted on the ice collected in the ice storage bin, wherein the plurality of blades comprises at least two rotary blades, the rotary blades being spaced apart from each other;

guide slopes provided in the ice storage bin in an inclined manner and, in addition, provided at opposite sides of the rotary blades, to guide ice toward the rotary blades, wherein the guide slopes comprise a first guide slope provided at one side of the rotary blades and a second guide slope provided at the other side of the rotary blades;

a stationary blade provided at one side of the ice storage bin to apply pressure to ice in cooperation with the rotary blades to crush the ice when the rotary blades are rotated in a first direction; and an opening and closing member provided at another side of the ice storage bin, the opening and closing member coming into contact with the ice discharged by the rotary blades and being urged by the ice to selectively open and close the discharge port when the rotary blades are rotated in a second direction, wherein the opening and closing member comprises:

a first guide way having a shape corresponding to a rotation track of the rotary blades;

a second guide way connected to the first guide way, the second guide way being provided such that the second guide way contacts one end of the inside guide slope, the second guide way having a gradient corresponding to the gradient of the inside guide slope such that the second guide way is continuous with the inside guide slope; and a hinge type rotation part connected to the second guide way, the hinge type rotation part being hingedly mounted below the second guide slope.

21. The refrigerator according to claim 20, wherein the opening and closing member further comprises:

a hinge shaft to support the hinge type rotation part; and an elastic member fitted on the hinge shaft, the elastic member having one end fixed to the ice storage bin and the other end fixed to the opening and closing member, such that the opening and closing member is elastically supported.

22. The refrigerator according to claim 20, wherein the hinge type rotation part is provided lower than a rotary shaft that is connected to the rotary blades such that the gradient of the second guide way corresponds to the gradient of the inside guide slope.

23. A refrigerator comprising:

an ice storage bin;

an opening provided in the ice storage bin through which ice is discharged;

a plurality of blades provided in the ice storage bin, such that the plurality of blades can rotate in a forward direction or in a reverse direction, to selectively discharge ice through the opening as whole ice or crushed ice, wherein gravity and the plurality of blades are the only forces exerted on the ice collected in the ice storage bin, wherein the plurality of blades comprises at least two rotary blades, the rotary blades being spaced apart from each other;

guide slopes provided in the ice storage bin in an inclined manner and, in addition, provided at opposite sides of the rotary blades, to guide ice toward the rotary blades, wherein the guide slopes comprise a first guide slope provided at one side of the rotary blades and a second guide slope provided at the other side of the rotary blades;

a stationary blade provided at one side of the ice storage bin to apply pressure to ice in cooperation with the rotary blades to crush the ice when the rotary blades are rotated in a first direction;

an opening and closing member provided at another side of the ice storage bin, the opening and closing member coming into contact with the ice discharged by the rotary blades and being urged by the ice to selectively open and close the discharge port when the rotary blades are rotated in a second direction; and a catching protrusion provided at the opening and closing member to catch ice placed on the opening and closing member to prevent the ice from being discharged out of the discharge port when the opening and closing member is closed.

24. A refrigerator comprising:

an ice storage bin;

an opening provided in the ice storage bin through which ice is discharged;

a plurality of blades provided in the ice storage bin, such that the plurality of blades can rotate in a forward direction or in a reverse direction, to selectively discharge ice through the opening as whole ice or crushed ice, wherein gravity and the plurality of blades are the only forces exerted on the ice collected in the ice storage bin, wherein the plurality of blades comprises at least two rotary blades, the rotary blades being spaced apart from each other;

guide slopes provided in the ice storage bin in an inclined manner and, in addition, provided at opposite sides of the rotary blades, to guide ice toward the rotary blades, wherein the guide slopes comprise a first guide slope provided at one side of the rotary blades and a second guide slope provided at the other side of the rotary blades;

a stationary blade provided at one side of the ice storage bin to apply pressure to ice in cooperation with the rotary blades to crush the ice when the rotary blades are rotated in a first direction;

an opening and closing member provided at another side of the ice storage bin, the opening and closing member coming into contact with the ice discharged by the rotary blades and being urged by the ice to selectively open and close the discharge port when the rotary blades are rotated in a second direction; and comprising an operation restriction unit provided below the opening and closing member, such that the operation restriction unit is spaced apart from the opening and closing member, to contact the opening and closing member to restrict an operation of the opening and closing member, such that the opening and closing member is operated in a predetermined range, when the opening and closing member opens the discharge port.

25. The refrigerator according to claim 24, wherein the operation restriction unit comprises:

a first vertical rib;

a second rib spaced apart from the first rib, the second rib having a greater length than the first rib; and an inclined contact part to interconnect an upper end of the first rib and an upper end of the second rib.

26. The refrigerator according to claim 25, wherein the opening and closing member comprises at least two opening and closing members configured to operate independently, and the first rib is disposed at an angle such that the at least two opening and closing members have different opening degrees.

27. A refrigerator comprising:

a refrigerator body having a storage chamber;

a door hingedly provided at the refrigerator body to open and close the storage chamber;

an ice storage bin detachably provided in the door;

an opening provided in the ice storage bin through which ice is discharged;

a guide slope provided in the ice storage bin to guide ice stored in the ice storage bin such that the ice moves toward a plurality of rotary blades by gravity, wherein the plurality of rotary blades is capable of rotating in a forward direction or in a reverse direction, the plurality of rotary blades disposed over the discharge port and a ice storage space to selectively discharge ice stored in the ice storage space as whole ice or crushed ice, wherein the ice storage space defined by the guide slope and a wall of the ice storage bin, wherein each of the rotary blades comprises:

radial extensions radially extending from a central part of each of the rotary blades, the extensions being spaced apart from each other;

ice receiving parts provided between the respective extensions to receive ice; and catching protrusions provided at opposite sides of one end of each of the extensions to prevent ice received in the ice receiving parts from being separated from the ice receiving.

28. The refrigerator according to claim 27, wherein the rotary blades comprises:

at least two rotary blades spaced apart from each other; and a rotary shaft to which the rotary blades are mounted.

29. The refrigerator according to claim 27, further comprising:

a stationary blade provided at the ice storage bin to apply pressure to ice in cooperation with the rotary blades to crush the ice into crushed ice when the rotary blades rotate in a first direction; and an opening and closing member provided adjacent to the rotary blades, the opening and closing member coming into contact with the ice to open the discharge port at the urging of the ice, such that the ice is discharged as whole ice, when the rotary blades are rotated in a second direction.

30. The refrigerator according to claim 27, wherein each of the rotary blades is provided at one side thereof with a saw-toothed crushing part to crush ice, and the stationary blade is also provided at one side thereof with a saw-toothed crushing part to crush ice.

31. The refrigerator according to claim 29, further comprising a discharge guide wall to which one end of the stationary blade is fixed, the discharge guide wall being formed at one side of the ice storage bin, such that the discharge guide wall is rounded, to prevent ice from remaining on the discharge guide wall.

32. The refrigerator according to claim 27, further comprising an ice catching prevention part formed at an inside wall of a front of the ice storage bin and protruding inward towards the rotary blades.

33. The refrigerator according to claim 27, wherein the guide slope comprises a first guide slope and a second guide slope provided at opposite sides of the ice discharge member, respectively, the first guide slope being located adjacent to the stationary blade, the second guide slope being located adjacent to the opening and closing member, and the second guide slope has a lower gradient than the first guide slope such that a speed of ice moving along the second guide slope is slower than a speed of ice moving along the first guide slope.

34. The refrigerator according to claim 33, wherein the first guide slope has a higher slope end point than a central part of the rotary blades to prevent crushed ice from moving upward along the first guide slope.

35. The refrigerator according to claim 33, wherein the opening and closing member comprises:

a hinge type rotation part hingedly provided at the ice storage bin;

an elastic member provided at the hinge type rotation part to elastically support the opening and closing member; and a guide way connected to the hinge type rotation part to guide movement of ice, the hinge type rotation part positioned lower than the second guide slope and a central axis of the ice discharge member such that a portion of the guide way is substantially continuous with the second guide slope.

36. The refrigerator according to claim 35, wherein the opening and closing member comprises at least two opening and closing members disposed in parallel, each of the at least two opening and closing members being independently operated without being affected by the other opening and closing members.

37. The refrigerator according to claim 35, further comprising a catching protrusion provided at the guide way of the opening and closing member to prevent ice from being discharged out of the discharge port when the opening and closing member is closed.

38. The refrigerator according to claim 29, further comprising an operation restriction unit provided below the opening and closing member to contact the opening and closing member such that the opening and closing member is opened in a predetermined range.

39. The refrigerator according to claim 38, wherein the opening and closing member comprises at least two opening and closing members configured to operate independently, and a contact part, contacting the opening and closing members, of the operation restriction unit is disposed at an angle such that the at least two opening and closing members have different maximum opening angles.

40. A refrigerator comprising:

a refrigerator body having a storage chamber;

a door hingedly provided at the refrigerator body to open and close the storage chamber;

an ice storage bin detachably provided in the door;

an opening provided in the ice storage bin through which ice is discharged;

a guide slope provided in the ice storage bin to guide ice stored in the ice storage bin such that the ice moves toward a plurality of rotary blades by gravity, wherein the plurality of rotary blades is capable of rotating in a forward direction or in a reverse direction, the plurality of rotary blades disposed over the discharge port and a ice storage space to selectively discharge ice stored in the ice storage space as whole ice or crushed ice, wherein the ice storage space defined by the guide slope and a wall of the ice storage bin, wherein the guide slope comprises a first guide slope and a second guide slope provided at opposite sides of the ice discharge member, respectively, the first guide slope being located adjacent to the stationary blade, the second guide slope being located adjacent to the opening and closing member, and the second guide slope has a lower gradient than the first guide slope such that a speed of ice moving along the second guide slope is slower than a speed of ice moving along the first guide slope, wherein the second guide slope comprises an outside guide slope connected to an inside wall of the ice storage bin and an inside guide slope formed more inside than the outside guide slope, the inside guide slope being continuous with a top of the opening and closing member, and the inside guide slope has a lower gradient than the outside guide slope such that a speed of ice moving along the outside guide slope is reduced when the ice reaches the inside guide slope.

41. A refrigerator comprising:

a refrigerator body having a storage chamber;

a door hingedly provided at the refrigerator body to open and close the storage chamber;

an ice storage bin detachably provided in the door or in the refrigerator body;

a discharge unit provided in the ice storage bin, the discharge unit having a discharge port through which ice is discharged;

a guide slope provided in the ice storage bin to guide ice stored in the ice storage bin such that the ice moves toward the discharge unit;

an ice storage space defined by the guide slope and a wall of the ice storage bin;

an ice discharge member provided in the ice storage bin, such that the ice discharge member is rotated in a forward direction or in a reverse direction, the ice discharge member being disposed between the discharge unit and the ice storage space, such that ice stored in the ice storage space does not escape from the ice storage space in a stopped state, to selectively discharge the ice stored in the ice storage space in a cube ice state or in a crushed ice state;

a drive motor to rotate the ice discharge member; and an ice discharge member rotation shaft mounted in the ice storage bin in a depressed manner to selectively connect the ice discharge member to the drive motor, the ice storage bin having a slope formed at a region where the ice discharge member rotation shaft is surrounded, wherein the guide slope comprises a first guide slope and a second guide slope provided at opposite sides of the ice discharge member, respectively, the first guide slope being located adjacent to the stationary blade, the second guide slope being located adjacent to the opening and closing member, and the second guide slope has a lower gradient than the first guide slope such that a speed of ice moving along the second guide slope is slower than a speed of ice moving along the first guide slope, wherein the second guide slope comprises an outside guide slope connected to an inside wall of the ice storage bin and an inside guide slope formed more inside than the outside guide slope, the inside guide slope being continuous with a top of the opening and closing member, and the inside guide slope has a lower gradient than the outside guide slope such that a speed of ice moving along the outside guide slope is reduced when the ice reaches the inside guide slope.

* * * * *